US005306598A

United States Patent [19]

Kolosick

[11] Patent Number: 5,306,598

[45] Date of Patent: Apr. 26, 1994

[54] SILVER HALIDE PHOTOGRAPHIC EMULSIONS AND ELEMENTS FOR USE IN HELIUM/NEON LASER AND LIGHT-EMITTING DIODE EXPOSURE

[75] Inventor: Clarence D. Kolosick, Binghamton, N.Y.

[73] Assignee: International Paper Company, Purchase, N.Y.

[21] Appl. No.: 983,610

[22] Filed: Nov. 30, 1992

Related U.S. Application Data

[63] Continuation of Ser. No. 819,651, Jan. 13, 1992, abandoned, which is a continuation of Ser. No. 486,020, Feb. 28, 1990, abandoned.

[51] Int. Cl.[5] ..... G03C 1/06

[52] U.S. Cl. ..... 430/264; 430/588; 430/598; 430/944; 430/945

[58] Field of Search ..... 430/264, 588, 598, 267, 430/410, 445, 944, 945, 363

[56] References Cited

U.S. PATENT DOCUMENTS

| | | | |
|---|---|---|---|
| 3,527,641 | 9/1970 | Nakazawa et al. | 430/588 |
| 4,622,290 | 11/1986 | Tanaka et al. | 430/588 |
| 4,686,167 | 8/1987 | Resnick et al. | 430/264 |
| 4,816,373 | 3/1989 | Ohashi et al. | 430/264 |
| 4,988,603 | 1/1991 | Takamuki et al. | 430/264 |

*Primary Examiner*—Charles L. Bowers, Jr.
*Assistant Examiner*—Thomas R. Neville
*Attorney, Agent, or Firm*—Darby & Darby

[57] ABSTRACT

A silver halide photographic material, suitable for exposure using Helium/Neon laser or light-emitting diode, contains silver bromide grains capable of forming a surface-latent image, a binder, a dot quality-promoting amount of at least one compound of the Formula I, and an effective amount for sensitizing said grains in the red region of the spectrum only one optical sensitizer compound of the Formula II:

(I)

(II)

wherein all the symbols are as defined in the specification.

5 Claims, No Drawings

SILVER HALIDE PHOTOGRAPHIC EMULSIONS AND ELEMENTS FOR USE IN HELIUM/NEON LASER AND LIGHT-EMITTING DIODE EXPOSURE

This is a continuation of application Ser. No. 07/819,651, filed Jan. 13, 1992, now abandoned, which is a continuation of application Ser. No. 486,020, filed Feb. 28, 1990, now abandoned.

FIELD OF THE INVENTION

This invention relates to high-contrast silver halide photographic materials for use in the field of graphic arts and in particular to photographic materials for use in Helium/Neon laser and LED (light-emitting diode) exposure.

BACKGROUND OF THE INVENTION

In the field of graphic arts, an image-forming system providing a super-high contrast photographic characteristic, especially one having a sensitivity ("gamma") of 10 or more, is required for satisfactory reproduction of continuous tone images or line images by dot images. For this purpose, a specific developer called a lith-type developer is generally used. The lith developer contains, as a developing agent, hydroquinone and, as a preservative, a sulfite usually in the form of an adduct with formaldehyde at a concentration of not more than 0.1 mol/1, thereby preventing deterioration of the infectious development ability of the developing agent. The lith developer has a serious disadvantage in that it is very susceptible to air oxidation and cannot withstand use for a period of time exceeding 3 days. Increasing the sulfite content of the developer improves its useful life but deteriorates its high-contrast development characteristics.

Known ways to obtain equivalent or substantially equivalent high-contrast photographic characteristics with a stable developer include the use of hydrazine or hydrazide derivatives as described for example in U.S. Pat. Nos. 4,224,401, 4,168,977, 4,166,742, 4,311,781, 4,272,606, 4,211,857 and 4,243,739 all incorporated by reference in their entirety. Use of hydrazine or hydrazide compounds in image formation systems provides super-high contrast and high sensitivity, and also ensures greatly improved stability of the developer against air oxidation as compared to the conventional lith developer because hydrazine (and/or derivative) presence in the film or in the developer permits use of a higher sulfite ion concentration in the developer.

For the light-exposure of certain photographic materials, various light sources such as Helium/Neon lasers and light-emitting diodes have been developed and are in use. To obtain emulsions with sufficient spectral sensitivity at these light frequencies, selected spectral sensitizing dyes have been used. Such emulsions required use of a lith developer.

It would be very desirable to incorporate in such emulsions (or in their developer) one or more of the hydrazides disclosed in U.S. Pat. No. 4,686,167, without decreasing speed below acceptable levels, and without causing unacceptable levels of color staining and "pepper".

SUMMARY OF THE INVENTION

The present invention includes silver-halide photographic emulsions and/or materials for use in Helium/Neon or LED exposure applications yielding high image quality on exposure at the requisite light frequency (red region) containing at least one optical sensitizing dye of Formula II below in conjunction with at least one hydrazide of Formula I below (the hydrazide may be incorporated in the emulsion or in another layer of the photographic material or in the developer).

Use of such hydrazides affords images with substantially better resolution contrast and dot quality but the requirements in Helium/Neon or LED applications include not only satisfactory photographic response characteristics but also freedom from:

unwanted sensitivity to normal darkroom safelights especially of the green type;

unacceptable amounts of high residual dye stain;

unwanted silver spots called "pepper".

The photographic materials of the present invention yield superior image quality, satisfactory safelight gap and have satisfactory freedom from dye stain compared to similar photographic materials containing other hydrazine compounds and/or optical sensitizers.

Preferably, the present materials also include a group VIII metal dopant, such as a rhodium salt.

The present materials are developed in a developer containing a dihydroxybenzene derivative (as a developing agent), a benzotriazole antifoggant, a sulfite preservative and an effective amount of an amine compound.

DETAILED DESCRIPTION OF THE INVENTION

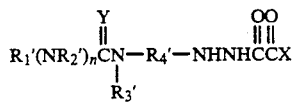

(Formula I)

wherein:

X=—$NR_5'R_6'$, or —$OR_7'$;

$R_1'$ and $R_2'$ are independently hydrogen and substituted or unsubstituted (i) alkyl, having up to 18 carbons; (ii) cycloalkyl; (iii) phenyl or naphthyl or iv) aryl sulfonyl.

$R_3'$ is hydrogen, phenyl or benzyl, the latter two substituted or unsubstituted, but if neither $R_1'$ nor $R_2'$ is hydrogen than $R_3'$ is hydrogen.

$R_4'$ is a substituted or unsubstituted divalent aromatic group.

$R_5'$, $R_6'$, and $R_7'$ are independently hydrogen, substituted or unsubstituted (i) alkyl having up to 12 carbons; (ii) cycloalkyl; (iii) phenyl or naphthyl.

$R_1'$ and $R_3'$ or $R_1'$ and $R_2'$ can be linked to form a heterocyclic ring system with the ring containing three to ten atoms.

$R_5'$ and $R_6'$ can be linked to form a heterocyclic ring system with the ring containing 3–10 atoms.

Y is an oxygen or sulfur atom; n=0,1, but if Y is sulfur then n=1.

Suitable substituents include without limitation halogen, hydroxy, alkoxy, amino, alkylamino, aryl, arylamino, cyano, acylamino. The substituents themselves may be further substituted.

Compounds of Formula II include:

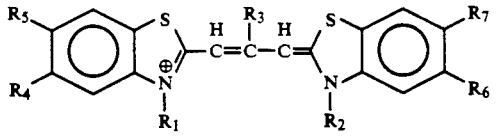

(II)

wherein:

$R_4$-$R_7$ are (each independently) lower ($C_1$-$C_6$) alkyl lower ($C_1$-$C_6$) alkoxy;

$R_3$ is $C_1$-$C_3$ alkyl;

$R_1$-$R_2$ are independently lower carboxy alkyl lower sulfonic acid alkyl lower alkyl.

The compound of the Formula I and the compound of the Formula II are preferably incorporated into the same layer, but may also be incorporated into different layers or the compound of Formula I can be used in the developing solution.

In the general Formula I described above, $R_1'$ preferably represents a hydrogen atom, an unsubstituted or substituted alkyl group (suitable preferred substituents include without limitation alkyl, cyano, halo, or alkoxy), a substituted or unsubstituted cycloalkyl group or a substituted or unsubstituted arylsulfonyl group. The total number of carbon atoms in $R_1'$ can be up to 18 but preferably, should be less than 12. Most preferably, $R_1'$ is unsubstituted alkyl or cycloalkyl containing 1-6 carbon atoms.

$R_2'$ is independently chosen from the group representing $R_1'$; preferably, however, the total number of carbon atoms between $R_1'$, and $R_2'$ should not exceed 12.

$R_3'$ preferably represents a hydrogen atom, an unsubstituted or substituted benzyl group (suitable preferred substituents include without limitation alkoxy, halo or alkyl). If neither $R_1'$ nor $R_2'$ is hydrogen, then $R_3'$ must be hydrogen. Most preferably, $R_3'$ is hydrogen.

In the preferred case, Y is a sulfur atom. If Y is a sulfur atom then n=1. In the most preferred case n=1.

$R_4'$ preferably represents either an unsubstituted or substituted divalent aromatic group. Suitable substituents include without limitation alkyl, alkoxy, halo, or acylamino functionalities. In the most preferred case $R_4'$ is phenylene with the thioamide or amido group in the ortho- or para-position relative to the hydrazido group. Furthermore, it is preferred that any suitable substituent as described herein be attached at a remaining, unoccupied ortho- or para-position relative to the hydrazine group.

$R_5'$ preferably represents either a hydrogen atom, an unsubstituted or substituted alkyl group (suitable preferred substituents include hydroxy, halo, alkoxy, alkylamino, acylamino, amino and aryl such as phenyl), a cycloalkyl group, an unsubstituted or substituted aryl group (suitable preferred substituents include alkyl, cyano, halo or alkoxy) or an unsubstituted or substituted amine. The total number of carbon atoms in $R_5'$ should be up to 12. Preferably, $R_5'$ is alkyl, cycloalkyl, dialkylaminoalkyl or acylaminoalkyl each containing 1-6 carbon atoms.

$R_6'$ and $R_7'$ are independently chosen from the group representing $R_5'$; preferably, however, the total number of carbon atoms between $R_5'$ and $R_6'$ should not exceed 12. In addition, $R_5'$ and $R_6'$ preferably do not contain amino functionalities that are directly linked to the nitrogen atom of X.

Furthermore, $R_5'$ and $R_6'$ can be linked to form a heterocyclic ring system with the ring containing 3-10 atoms.

Additionally, either $R_1'$ and $R_3'$ or $R_1'$ and $R_2'$ can be linked to form a heterocyclic ring system with the ring containing 3-10 atoms.

The preferred compounds represented by the general Formula I are those represented by the general Formula (IA).

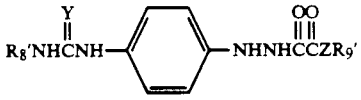

(Formula IA)

In this formula, Y=S or 0; Z=0 or HN; $R_8'$ and $R_9'$ have the same meaning as $R_1'$ and $R_5'$ respectively for the above described general Formula I. Most preferably $R_8'$ is ethyl, n-butyl or cyclohexyl, $R_9'$ is hydrogen, methyl, ethyl, dimethylaminoethyl or acetylaminoethyl, Z=HN, and Y=S.

Specific examples of the compounds represented by the general Formula I are given below in Table I, but the present invention is not limited to these examples. In fact, the present invention broadly involves the use or incorporation of a Formula II compound, in an amount sufficient to reduce or eliminate pepper, in any high-contrast image forming system (photographic material and/or developer) containing a contrast-enhancing amount of a hydrazine or hydrazide compound.

TABLE I

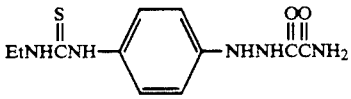

(I-1)

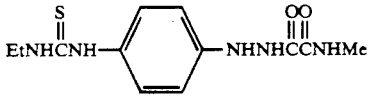

(I-2)

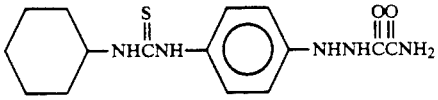

(I-3)

-continued
(I-4)
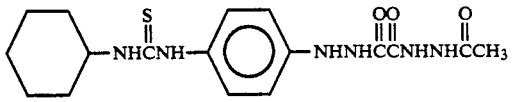
(I-5)
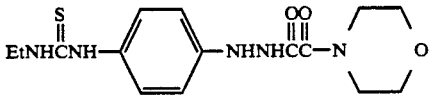
(I-6)
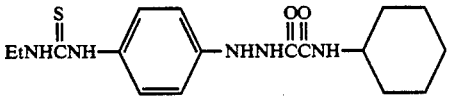
(I-7)
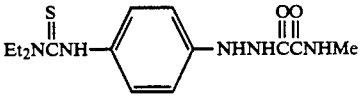
(I-8)
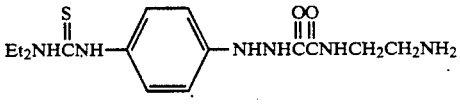
(I-9)
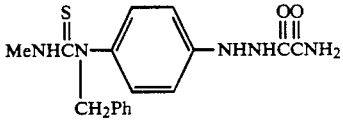
(I-10)
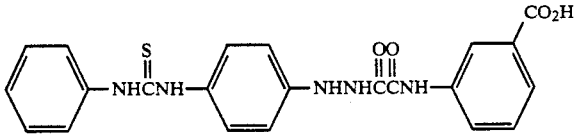
(I-11)
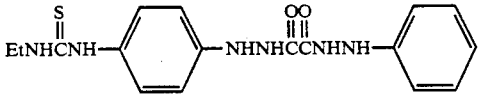
(I-12)
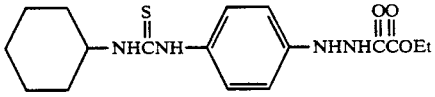
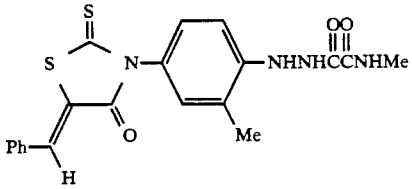
(I-14)
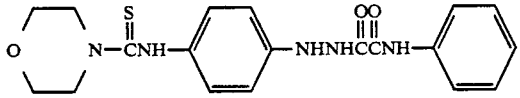
(I-15)
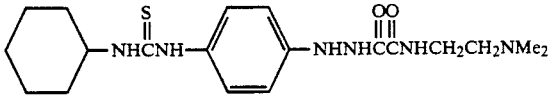

-continued
(I-16)
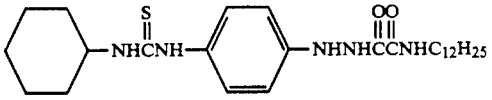
(I-17)
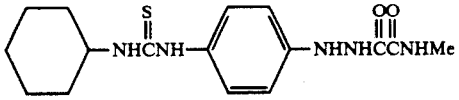
(I-18)
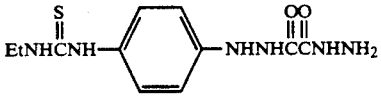
(I-19)
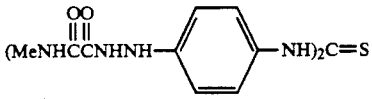
(I-20)
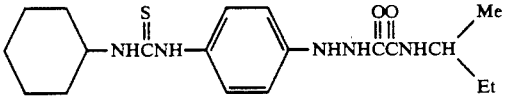
(I-21)
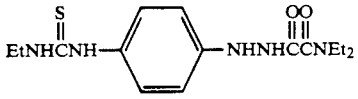
(I-22)
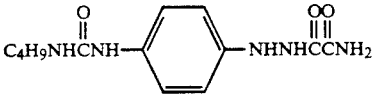
(I-23)
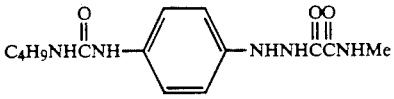
(I-24)
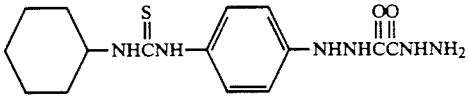
(I-25)
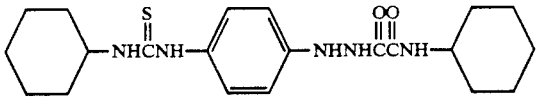
(I-26)
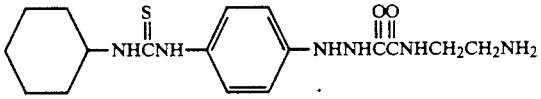
(I-27)
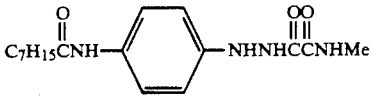
(I-28)
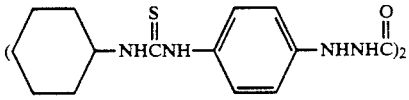

-continued (I-29)

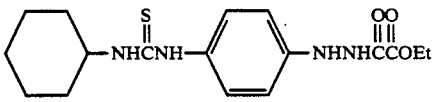

The amount of the compound of Formula I added to the silver halide emulsion layer or to one or more hydrophilic colloidal layer(s) is such that the compound enhances contrast but does not appreciably function as a developer. Typically, amounts from about $10^{-8}$ to about $5\times10^{-3}$ moles/mole Ag and preferably from about $10^{-5}$ to about $5\times10^{-4}$ mole/mole Ag are used.

The compound of Formula I and II can be incorporated in the photographic element by well-known techniques used for the incorporation of additives to photographic emulsions or elements. The compounds are typically dissolved in a solvent selected from organic solvents compatible with water, such as alcohols, glycols, ketones, esters, amides, and the like which exert no adverse influences on photographic characteristics, and the solution is added to the photographic element. Preferred solvents include dimethylformamide (DMF), dimethylsulfoxide (DMSO) and N-methyl-2-pyrrolidinone (NMP).

Alternatively, the compound of Formula I and II can be added to an emulsion in a dispersion by known methods used when water-insoluble (so-called "oil soluble") couplers are added to emulsions. Preferred oils include N-butyl acetanilide, N-methyl formanilide and N,N-diethyl-m-toluamide. These oils are commercially available. Ultrasound can be employed to dissolve (more precisely finely disperse) marginally soluble ethanedioic acid hydrazides. These solutions or dispersions can be added to the photographic emulsion at any stage subsequent to the emulsion precipitation and washing steps. Preferably these agents should be added during chemical ripening or just prior to coating.

Gelatin is advantageously used as a binder or protective colloid in the photographic emulsion, but other hydrophilic colloids can also be used. For example, gelatin derivatives, graft polymers of gelatin with other high molecular weight materials, proteins such as albumin or casein; cellulose derivatives such as hydroxyethyl cellulose, carboxymethyl cellulose or cellulose sulfate, saccharide derivatives such as sodium alginate or starch derivatives, polyglycoside dextrans and various synthetic hydrophilic high molecular weight materials such as homopolymers or copolymers of e.g., polyvinyl alcohol, polyvinyl alcohol (partial acetal), poly-N-vinyl pyrrolidone, polyacrylic acid, polymethacrylic acid, polyacrylamide, polyvinyl imidazole, polyvinyl pyrazole, etc., can also be used. Gelatin is preferred. All these materials are well-known and commercially available.

Lime-processed gelatin and acid-processed gelatin can alternatively be used as the gelatin. Hydrolyzed or enzyme-decomposed gelatin can also be used. Suitable gelatin derivatives are prepared by reacting gelatin with various compounds such as acid halides, acid anhydrides, isocyanates, bromoacetic acid, alkanesulfones, vinylsulfonamides, maleinimide compounds, polyalkylene oxides or epoxy compounds and, preferably, with phthalic anhydride or succinic anhydride. Specific examples of these gelatin derivatives are described in e.g., U.S. Pat. Nos. 2,614,928, 3,132,945, 3,186,846 and 1,005,784, all incorporated by reference.

Examples of suitable gelatin graft polymers include those prepared by grafting a homopolymer or a copolymer of a vinylic monomer such as acrylic acid, methacrylic acid, the derivatives thereof (such as the esters or the amides thereof), acrylonitrile or styrene to gelatin. In particular, graft polymers prepared from polymers which are compatible with gelatin to some degree, such as those of acrylic acid, methacrylamide or a hydroxyalkyl methacrylate which are preferred. Examples of those polymers are described in, e.g., U.S. Pat. Nos. 2,763,625, 2,831,767 and 2,956,884. Typical synthetic hydrophilic high molecular weight materials are described in, e.g., German Patent Application (OLS) 2,312,708, U.S. Pat. Nos. 3,620,751 and 3,879,205, all incorporated by reference.

The photographic emulsion used in this invention can be prepared using the well-known methods described in, e.g., P. Glafkides, Chimie et Physique Photographique, Paul Montel, Paris (1967), G. F. Duffin, Photographic Emulsion Chemistry, The Focal Press, London (1966), V. L. Zelikman et al., Making and Coating Photographic Emulsions, the Focal Press, London (1964), all incorporated by reference. These methods include the acid method, the neutral method, the ammonia method and others. Moreover, a soluble silver salt can be reacted with a soluble halogen salt using any of the single jet method, the double jet method and a combination thereof. The well-known method of forming grains in the presence of an excess of silver ions (the so-called "reverse mixing method") can also be used. The "controlled double jet method" (also called "controlled diffusion method") is preferred. According to this method, the pAg of the liquid phase (in which the silver halide is to be produced) is kept constant. This method can provide silver halide emulsions having a regular crystal form and an almost uniform grain size.

The silver halide grains in the photographic emulsion used in this invention can have a relatively wide grain size distribution, but a narrow grain size distribution is preferred. In particular, the size of the silver halide grains amounting to 90% of the total, based on the weight or number of the grains, is preferably within +40% of the average grain size (such an emulsion is usually called a monodispersed emulsion). Grain size can be controlled by known techniques such as are disclosed in, e.g. U.S. Pat. No. 3,271,157; No. 3,704,130; No. 3,574,628; No. 4,276,374 and No. 4,297,439 and in Research Disclosures RD No. 17643, December 1978 and 18716, November 1979, all incorporated by reference.

The individual reactants can be added to the reaction vessel through surface or sub-surface delivery tubes by gravity feed or by delivery apparatus for maintaining control of the pH and/or pAg of the reaction vessel contents, as illustrated by Culhane et al U.S. Pat. No. 3,821,002, Oliver U.S. Pat. No. 3,031,304 all incorporated by reference. In order to obtain rapid distribution of the reactants within the reaction vessel, specially constructed mixing devices can be employed, as illustrated by Audran U.S. Pat. No. 2,996,287, McCrossen et al U.S. Pat. No. 3,342,605, Frame et al U.S. Pat. No.

3,415,650, Porter et al U.S. Pat. No. 3,785,777, Saito et al German OLS No. 2,556,885 and Sato et al German OLS No. 2,555,364 all incorporated by reference. An enclosed reaction vessel can be employed to receive and mix reactants upstream of the main reaction vessel, as illustrated by Forster et al U.S. Pat. No. 3,897,935 and Posse et al U.S. Pat. No. 3,790,386, all incorporated by reference.

The grain size distribution of the silver halide emulsions can be controlled by silver halide grain separation techniques or by blending silver halide emulsions of differing grain sizes. The emulsions can include ammoniacal emulsions, as illustrated by Glafkides, Photographic Chemistry, Vol. 1, Fountain Press, London, 1958, pp. 365-368 and pp. 301-304; thiocyanate ripened emulsions, as illustrated by Illingsworth U.S. Pat. No. 3,320,069; thioether ripened emulsions, as illustrated by McBride U.S. Pat. No. 3,271,157, Jones U.S. Pat. No. 3,574,628 and Rosecrants et al U.S. Pat. No. 3,737,313 or emulsions containing weak silver halide solvents, such as ammonium salts, as illustrated by Perignon U.S. Pat. No. 3,784,381 and Research Disclosure, Vol. 134, June 1975, Item 13452 all incorporated by reference. The method using ammonium salts is preferred.

The crystal form of the silver halide grains in the photographic emulsion may be regular (such as cubic or octahedral) or irregular (such as spherical or plate-like) or it may be a composite of these forms. The grains may comprise mixed grains having various crystal forms.

The interior and the surface layer of the silver halide grain may be different or the grains may be uniform throughout. During the process of the formation or physical ripening of the grains, cadmium salts, zinc salts, lead salts, thallium salts, rhodium salts or complex salts thereof, iron salts or iron complex salts, and the like can be present, as can mixtures thereof. Preferred as such dopants, are rhodium or iridium salts or mixtures thereof.

Two or more of silver halide emulsions which are separately prepared can be mixed and then used, if desired.

After the formation of the precipitates or after physical ripening, the soluble salts are usually removed from the emulsion. For this purpose, the well known noodle washing method may be used. Alternatively, the flocculation method may be used. This method employs an inorganic salt having a polyvalent anion such as sodium sulfate, an anionic surface active agent, an anionic polymer (such as polystyrene sulfonic acid) or a gelatin derivative (such as an aliphatic acylated gelatin, an aromatic acylated gelatin or an aromatic carbamoylated gelatin). The removal of the soluble salts may be omitted, if desired.

Although the silver halide emulsions used in the present invention do not need to be chemically sensitized, chemically sensitized silver halide emulsions are preferred. Processes for chemical sensitization of the silver halide emulsions which can be used include known sulfur sensitization, reduction sensitization and noble metal sensitization processes. In addition to sulfur sensitization, selenium, tellurium, rhenium sensitizers or combinations of these sensitizers can be used. Chemical ripening can be performed at pAg levels of from 5 to 10, pH levels of from 5 to 8 and at temperatures from 30° to 80° C.

These processes are described in references such as P. Glafkides, Chimie et Physique Photographique, Paul Montel, Paris (1967) or Zelikmann, Making and Coating Photographic Emulsions, The Focal Press, London (1964) or H. Frieser, Die Gundlagen der Photographischen Prozesse mit Silberhalogeniden, Akademische Verlagsgesellschaft (1968). The disclosure of these references is incorporated by reference. In the noble metal sensitization processes, a gold sensitization process is a typical process where gold compounds or gold complexes are used.

Complexes of noble group VIII metals other than gold, such as those of platinum, palladium, osmium, rhodium or iridium, etc. can also be used as chemical sensitizers. A reduction sensitization process may be used if the process does not generate fog to a degree which causes practical difficulties (with or without the use of known antifoggents). A particularly preferred chemical sensitization process for the present invention is the use of a sulfur sensitization process.

Examples of sulfur sensitizing agents which can be used include not only sulfur compounds present in the gelatin per se, but also various sulfur compounds such as thiosulfates, thioureas, thiazoles or rhodanines, etc. Examples of suitable sulfur compounds are described in U.S. Pat. Nos. 1,574,994, 2,410,689, 2,278,947, 2,728,668 and 3,656,955, all incorporated by reference. Typical examples of reduction-sensitizing agents include stannous salts, amines, formamidine sulfinic acid and silane compounds, methyldichlorosilane, hydrazine derivatives, boranes such as aminoboranes, thiourea dioxide, hydrogen, and other boron hydrides such as cyanoborohydrides. Reduction sensitization can also be obtained by low pAg (less than 5) or high pH (greater than 8) treatment, as is well-known in the art.

Specifically contemplated is the combined use of several of the aforementioned chemical ripening techniques; in particular gold-sulfur sensitization combinations are highly preferred.

A photographic material used in this invention may contain an antifoggant. Examples of antifoggants which can be advantageously used for the photographic material used in this invention are 1,2,4-triazole compounds substituted with a mercapto group at the 3-position, benzotriazole compounds, 2-mercaptobenzimidazole compounds (which do not contain a nitro group), 2-mercaptopyrimidines, 2-mercaptothiazoles, 2-mercaptobenzothiazoles, benzothiazolium compounds (such as N-alkyl-benzothiazolium halides, nitrobenzindazole, substituted triazaindolizines (tetraazaindenes) or N-allylbenzothiazolium halides), and 2-mercapto-1,3,4-thiazoles. Antifoggants which are not effective when used alone, such a 6-nitrobenzimidazole, however, can be used in combination with advantageous antifoggants.

It has been observed that both fog reduction and an increase in contrast are obtainable by employing benzotriazole antifoggants. When the benzotriazole is located in the photographic element concentrations of $10^{-4}$ to $10^{-1}$, preferably $10^{-3}$ to $3\times10^{-2}$, mole per mole of silver are employed.

Useful benzotriazoles can be chosen from among conventional benzotriazole antifoggants, such as those disclosed by Land U.S. Pat. No. 2,704,721 and Rogers et al U.S. Pat. No. 3,265,498, both incorporated by reference. The preferred benzotriazoles for use in this invention are benzotriazole (that is, the unsubstituted benzotriazole compound), halo-substituted benzotriazoles (e.g., 5-chlorobenzotriazole, 4-bromobenzotriazole and 4-chlorobenzotriazole) and alkyl-substituted benzotriazoles wherein the alkyl moiety contains from about 1 to 12 carbon atoms (e.g., 5-methyl-benzotriazole). 5-methylbenzotriazole is most preferred. The use of 5-methylbenzotriazole as an antifoggant is illustrated by Baldassari et al U.S. Pat. No. 3,925,086, incorporated by reference.

The photographic emulsions used in this invention can be used for camera exposure. To insure good safelight protection UV absorbing compounds are used, such as those in U.S. Pat. Nos. 3,533,794; 3,314,794 and 3,352,681, all incorporated by reference. Safelight dyes such as oxonols, hemioxonols, styryl dyes, merocyanine dyes and aso dyes can also be used, as long as such dyes are easily removed or decolorized during processing (see U.S. Pat. Nos. 2,274,782; 2,956,879; 3,423,207; 3,976,661 and 3,384,487, all incorporated by reference). Desensitizing dyes (see, e.g. U.S. Pat. No. 3,501,307, incorporated by reference) can also be used.

The present emulsion is spectrally sensitized with at least one spectrally-sensitizing dye of Formula II.

Compounds II-1 and II-2, below, are most preferred.

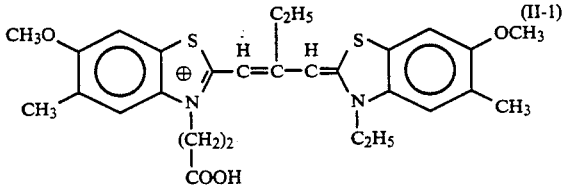

(II-1)

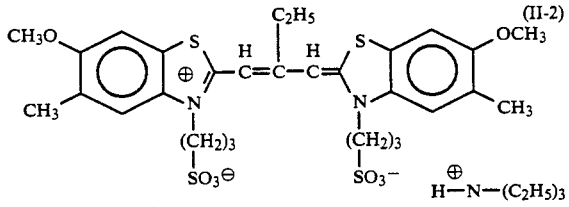

(II-2)

The compounds of Formula II are preferably incorporated in amounts ranging from about 0.5 to about 1 mg/g Ag. The most preferred amount depends on the particular emulsion Formula I compound and Formula II compound but for compounds I-1 and II-2 this amount is 0.77 mg/g Ag when the hydrazide is I-2.

Optionally, compounds of Formula III, which reduce pepper can also be added. These are defined as follows:

Formula III

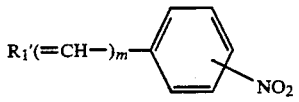

wherein m is an integer between 0 and 6 inclusive; $R_1'$ is selected from the group consisting of benzothiazole, quinoline, indolenine, nitrobenzothiazole, benzotriazole and rhodanine, each of which may be unsubstituted or substituted by, e.g. halogen, hydroxy, alkoxy, aryl, amino, arylamine, sulfuric acid, carboxylic acid, phenyl, etc., or fused to the nitrobenzene nucleus.

Preferably, $R_1'$ is substituted by hydrogen or carboxy and m is 1. Furthermore, the substituents in $R_1'$ are preferably in the 3-position if the ring S is 1 and numbering is clockwise.

Compounds of Formula III, include compounds containing one moiety selected from the group consisting of benzothiazoles, quinolines, indolenine benzotriazoles, and rhodanines having one or more nitro groups attached to a benzene nucleus, which is either a part of the heterocyclic compound or is attached to it through a doubly-bonded carbon-to-carbon chain. The quaternary salts (such as ammonium, triethylamine, piperidine and alkali metal sals, preferably methanol-soluble) of the benzothiazoles, quinolines and indolenines are also suitable.

The range of substantial pepper reduction effectiveness of such compounds is generally between about $5\times10^{-8}$ and about $1\times10^{-3}$ moles/mole Ag and preferably about $10^{-5}$ to about $10^{-4}$ moles/mole Ag. (The present emulsion is preferably used at 3.6 g Ag/m$^2$.)

Additional sensitizing dyes as well as supersensitizers and optical brighteners may be used among those known in the art, provided of course that such materials do not interfere with spectral sensitization imparted by the Formula II compounds. Examples of such sensitizers can be found, e.g., in U.S. Pat. No. 4,725,532. Examples of supersensitizing compounds can be found, e.g., in U.S. Pat. No. 3,527,641.

A water-soluble dye may be present in any of the hydrophilic colloid layers in the photographic light-sensitive materials used in this invention, for example, as a filter dye or for prevention of light scattering, or for antihalation. Examples of these dyes include oxonol dyes, hemioxonol dyes, styryl dyes, merocyanine dyes, cyanine dyes and azo dyes. Of these dyes, oxonol dyes, hemioxonol dyes and merocyanine dyes are particularly useful. Specific examples of dyes which can be used are those described in British Patent Nos. 584,609 and 1,177,429, and U.S. Pat. Nos. 2,274,782, 2,533,472, 2,956,879, 3,148,187, 3,177,078, 3,247,127, 3,540,887, 3,575,704, 3,653,905 and 3,718,472, all incorporated by reference.

An inorganic or organic hardener may be present in any of the hydrophilic colloid layers in the light-sensitive material used in this invention. These hardeners include, for example, chromium salts (such as chrome alum or chromium acetate), aldehydes (such as formaldehyde, glyoxal or glutaraldehyde), N-methylol compounds (such as dimethylolurea or methyloldimethylhydantoin), dioxane derivatives (such as 2,3-dihydroxydioxane), active vinyl compounds (such as 1,3,5-triacryloyl-hexahydro-s-triazine or bis(vinylsulfonyl) methyl ether), active halogen compounds (such as 2,4-dichloro-6-hydroxy-s-triazine), mucohalic acids (such as mucochloric acid or mucophenoxychloric acid), isooxazoles, dialdehyde starch, 2-chloro-6-hydroxytriazinylated gelatin and the like can be used individually or in combination. Specific examples of these compounds are described, e.g., U.S. Pat. Nos. 1,870,354, 2,080,019, 2,726,162, 3,870,013, 2,983,611, 2,992,109, 3,047,394, 3,057,723, 3,103,437, 3,321,313, 3,325,287, 3,362,827, 3,539,664 and 3,543,292, British Patent Nos. 676,628, 825,544 and 1,270,578, German Patent Nos. 872,153 and 1,090,427, all incorporated by reference. A preferred hardener is one that will not cause reduction-sensitization (formaldehyde, for example, should be avoided). An example of a preferred hardener is dichlorohydroxytriazine.

The light-sensitive material of this invention may contain various known surface active agents for various purposes, e.g., as a coating aid, for preventing the generation of static charges, improving slip characteristics, improving emulsion dispersion, preventing adhesion, improving photographic characteristics (e.g., accelerating development, increasing contrast, sensitization), etc.

Examples of suitable surfactants are: nonionic surface active agents such as saponin (steroids), alkylene oxide derivatives (such as polyethylene glycol, polyethylene glycol/polypropylene glycol condensates, polyethylene glycol alkyl or alkylaryl ethers, polyethylene glycol esters, polyethylene glycol sorbitan esters, polyalkylene glycol alkylamines or amides or silicone/polyethylene oxide adducts), glycidol derivatives (such as alkenylsuccinic acid polyglycerides or alkylphenol polyglycerides), aliphatic esters of polyhydric alcohols, alkyl esters of sucrose, urethanes or ethers; anionic surface active agents containing an acidic group such as a carboxy group, a sulfo group, a phospho group, a sulfuric acid ester group or a phosphoric acid ester group, such as triterpenoid type saponin, alkylcarboxylates, alkylsulfonates, alkylbenzenesulfonates, alkylnaphthalenesulfonates, alkyl sulfuric acid esters, alkyl phosphoric acid esters, N-acyl-N-alkyltaurines, sulfosuccinates, sulfoalkylpolyoxy ethylene alkylphenyl ethers or polyoxyethylene alkylphosphates; amphoteric surface active agents such as amino acids, aminoalkylsulfonic acids, aminoalkylsulfuric acid esters, aminoalkylphosphoric acid esters, alkylbetaines, amineimides or amine oxides; and cationic surface active agents such as alkylamine salts, aliphatic or aromatic quaternary ammonium salts, (such as pyridinium or imidazolium salts) or phosphonium or sulfonium salts containing an aliphatic or heterocyclic ring.

Specific examples of these surface active agents are those described in, e.g., U.S. Pat. Nos. 2,240,472, 2,831,766, 3,158,484, 3,210,191, 3,294,540 and 3,507,660, British Patent Nos. 1,012,495, 1,022,878, 1,179,290 and 1,198,450, U.S. Pat. Nos. 2,739,891, 2,823,123, 3,068,101, 3,415,649, 3,666,478 and 3,756,828, British Patent No. 1,397,218, U.S. Pat. Nos. 3,133,816, 3,441,413, 3,475,174, 3,545,974, 3,726,683 and 3,843,368. Belgium Patent No. 731,126, British Patent Nos. 1,138,514, 1,159,825 and 1,374,780, U.S. Pat. Nos. 2,271,623, 2,288,226, 2,944,900, 3,253,919, 3,671,247, 3,772,021, 3,589,906 and 3,754,924, all incorporated by reference. Specifically preferred is a mixture of saponin, nonionic surfactants such as aliphatic esters of polyhydric alcohols, and an anionic surfactant containing a sulfuric acid ester group.

The photographic emulsion used in this invention can contain a dispersion of a synthetic polymer which is insoluble or slightly soluble in water for the purpose of improving the dimensional stability, the development and the fixing and drying rates. Examples of polymers which can be used include polymers composed of one or more alkyl acrylates or methacrylates, alkoxyalkyl acrylates or methacrylates, glycidyl acrylates or methacrylates, acyl or methacrylamide, vinyl esters (for example, vinyl acetate), acrylonitrile, olefins and styrene, etc., and polymers comprising a combination of the above described monomers and acrylic acid, methacrylic acid, unsaturated dicarboxylic acids, hydroxyalkyl acrylates or methacrylates or styrenesulfonic acid, etc. For example, those compounds described in U.S. Pat. Nos. 2,376,005, 2,739,137, 2,853,457, 3,062,674, 3,411,911, 3,488,708, 3,525,620, 3,607,290, 3,635,715 and 3,645,740, and British Patent Nos. 1,186,699 and 1,307,373, all incorporated by reference, can be used. A suitable amount of the polymer ranges from about 20 to 80% by weight based on the total weight of the binders. Since high-contrast emulsions such as that used in this invention are suitable for the reproduction of line drawings and the dimensional stability is of importance for such a purpose, it is preferred to use the above-described polymer dispersion to be employed.

In addition to the components of the photographic emulsions and other hydrophilic colloid layers described above, it is appreciated that other conventional agents compatible with obtaining relatively high contrast images can be present. For example, the photographic elements can contain developing agents (described below in connection with the processing steps), development modifiers, plasticizers and lubricants, coating aids, antistatic materials, matting agents, brighteners and color materials, these conventional materials being illustrated in Paragraphs V, VIII, XI, XII and XVI of Research Disclosure, December 1978 Item 17643, all incorporated by reference. Preferably, the photographic emulsion also contains anti-ageing agents, useful to prolong the shelf life of the emulsion. Suitable anti-ageing agents (especially for rhodium-doped emulsions) include polyhydroxyspiro-bis-indane as disclosed in U.S. Pat. No. 4,346,167 of E. Imatomi and preferably phenidone (up to 2 g/kg of emulsion) as disclosed in U.S. Pat. No. 2,751,297 of G. Hood.

In forming photographic elements, the layers can be applied on photographic supports by various procedures including immersion or dip coating, roller coating, reverse roll coating, air knife coating, doctor blade coating, gravure coating, spray coating, extrusion coating, bead coating, stretch-flow coating and curtain coating. High speed coating using a pressure differential is illustrated by Beguin U.S. Pat. No. 2,681,294. Controlled variation in the pressure differential to facilitate coating starts is illustrated by Johnson U.S. Pat. No. 3,220,877 and to minimize splicing disruptions is illustrated by Fowble U.S. Pat. No. 3,916,043. Coating at reduced pressures to accelerate drying is illustrated by Beck U.S. Pat. No. 2,815,307. Very high speed curtain coating is illustrated by Greiller U.S. Pat. No. 3,632,374. Two or more layers can be coated simultaneously, as illustrated by Russell U.S. Pat. No. 2,761,791, Wynn U.S. Pat. No. 2,941,898, Miller et al U.S. Pat. No. 3,206,323, Bacon et al U.S. Pat. No. 3,425,857, Hughes U.S. Pat. No. 3,508,947, Herzhoff et al U.K. Patent No. 1,208,809, Herzhoff et al U.S. Pat. No. 3,645,773 and Dittman et al U.S. Pat. No. 4,001,024. In simultaneous multilayer coating varied coating hoppers can be used, as illustrated by Russell et al U.S. Pat. No. 2,761,417, Russell U.S. Pat. Nos. 2,761,418 and 3,474,758, Mercier et al U.S. Pat. No. 2,761,419, Wright U.S. Pat. No. 2,975,754, Padday U.S. Pat. No. 3,005,440, Mercier U.S. Pat. No. 3,627,564, Timson U.S. Pat. Nos. 3,749,053 and 3,958,532, Jackson U.S. Pat. No. 3,933,019 and Jackson et al U.S. Pat. No. 3,996,885. Silver halide layers can also be coated by vacuum evaporation, as illustrated by Lu Valle et al U.S. Pat. Nos. 3,219,444 and 3,219,451.

The photographic emulsions are coated on conventional supports which do not undergo serious dimensional changes during processing. Typical suitable supports which can be used are a cellulose acetate film, a polystyrene film, a polyethylene terephthalate film, a polycarbonate film, a laminate thereof, paper, baryta paper, paper coated on laminated with a hydrophobic polymer such as polyethylene, polypropylene, etc. as are commonly used for photographic light-sensitive materials. Transparent supports can be employed for certain end uses of the light-sensitive material. Also, transparent supports may be colored by adding a dye or a pigment thereto as described in J. SMPTE, 67, 296 (1958), or Cleare, U.S. Pat. No. 3,822,131 (1984), incorporated by reference. Where the adhesion between the support and the photographic emulsion layer(s) is insufficient, a subbing layer (an adhesive layer) that adheres to both the support and the photographic emulsion layer(s) can be employed. Also, in order to improve the adhesion, surface of the support may be subjected to a preliminary processing such as corona discharge, irradiation with ultraviolet light, flame treatment, etc. A suitable coating amount of silver is about 0.5 $g/m^2$ to about 10 $g/m^2$ of the support.

The photographic elements can be imagewise exposed with various forms of energy.

The photographic light-sensitive material of this invention can be photographically processed using known methods and known processing solutions. The processing temperature usually ranges from about 18° to about 50° C., but temperatures lower than about 18° C. or higher than about 50° C. may be used. This invention is particularly useful for the formation of an image by development in which a silver image is formed (a black-and-white photographic processing).

The developers used for black-and-white photographic processing preferably contain, as a developing agent, aminophenols (such as N-methyl-p-aminophenol), 3-pyrazolidones (such as 1-phenyl-3-pyrazolidone), 1-phenyl-3-pyrazolines, dihydroxybenzenes (such as hydroquinone) and other of the aforementioned developing agents. Specific examples of the useful developing agents include hydroquinone alone, hydroquinone plus N-methyl-p-aminophenol, hydroquinone plus 1-phenyl-3-pyrazolidone, and hydroquinone plus N-methyl-p-aminophenol plus 1-phenyl-3-pyrazolidone. Moreover, the developers usually contain a known antioxidant, an alkali agent, a pH buffer or the like and, if desired, a dissolving aid, a color toning agent, a development accelerator, a surface active agent, an anti-foaming agent, a water softener, a hardener, a tackifier, etc., may be present. An anti-fogging agent (such as an alkali metal halide or benzotriazole) may be present in the developer.

According to this invention, even when development is carried out using a developer containing more than about 0.15 mol/1 of sulfite ions, a gamma of more than 8 can be obtained. The pH of the developer is preferably about 11 to about 12.3. If the pH exceeds about 12.3, the developer is unstable even when a high concentration of sulfite ions is present, and it is difficult to maintain stable photographic characteristics for more than 3 days under usual use conditions.

Fixing solutions having a composition generally employed in the art can be used in the present invention. Not only thiosulfates and thiocyanates but also organic sulfur compounds known as fixing agents can be used as fixing agents in the present invention.

Preferred examples of fixing agents which can be used in the fixing solution include water-soluble thiosulfates such as sodium thiosulfate, potassium thiosulfate, ammonium thiosulfate, etc., water-soluble thiocyanates such as sodium thiocyanate, potassium thiocyanate, ammonium thiocyanate, etc., water-soluble organic diol fixing agents containing an oxygen atom or a sulfur atom such as 3-thia-1,5-pentanediol, 3,6-dithio-1,8-octanediol, 9-oxo-3,6,12,15-tetrathio-1,17-heptadecanediol, etc., water soluble sulfur-containing organic dibasic acids and water-soluble salts thereof such as ethylenebisthioglycollic acid and the sodium salt thereof, etc., imidazolidimethiones such as methylimidazolidimethione, etc. These agents described in L. F. A.Mason, Photographic Processing Chemistry, pages 187 to 188, Focal Press (1966).

A particularly preferred developing system in accordance with the present invention contains a hydroquinone developing agent, a benzotriazole antifogging agent (development restrainer), diethylaminopropanediol, sodium sulfite, and a pH modifier (preferably NaOH and/or $Na_2CO_3$) to adjust the pH to 11.6±0.5. The most preferred developing system is set forth in the Examples below.

The preferred ethanedioic acid hydrazides of the present invention are listed in Table I. Among them, the semi-oxamazides I-1, I-2, I-3 and I-15 are particularly preferred.

EXAMPLE 1

Preferred are compounds II-1, and II-2 and inner and/or ionic salts (such as e.g. bromide, iodide, triethylamino etc.) thereof. The triethylamino salt of compound II-2 is particularly preferred.

The compounds of Formula II can be synthesized as follows:

2,5-dimethyl-6-methoxy-benzothiazole can be synthesized as described in U.S. Pat. No. 4,515,888;

3-ethyl-2,5 dimethyl-6-methoxy-benzothiazole iodide can be synthesized as described in U.S. Pat. No. 4,515,888.

These two compounds are reacted under well-known condensation/bridging conditions as described in "Heterocyclic Compounds", F. M. Hamer, Interscience 1964.

The thiazole can be reacted with TEOP (triethyloxypropyne) to form the "bridge" between heterocyclics.

In general, synthetic schemes for making these compounds are well known to those of ordinary skill in the field. See, e.g. U.S. Pat. No. 3,527,641, which discloses compounds within Formula II.

Emulsions according to the invention were prepared and developed as follows:

A gelatino (silver bromide) emulsion was prepared at 62° C. for 37 minutes by a controlled double jet addition technique (using silver nitrate and potassium bromide) while the pAg was maintained at 8.5, in the presence of 0.006 mg/g Ag of sodium hexachlororhodate. The average grain size was 0.24 micron with a size distribution of 12%. After removal of the soluble salts by conventional methods, the emulsion was chemically ripened using both labile sulfur and gold agents at 63° C. for 70 min.

This surface sensitized emulsion contained 69 g of gelatin per mole Ag. Compound I-2 (0.22 mg/g Ag) and Compound II-2 (0.3–1.4 mg/g Ag) were incorporated in the emulsion. The emulsion was coated at 3.5 $g/m^2$ and exposed to "red" light using an optical wedge with a W-72B Eastman Kodak filter for $10^{-3}$ seconds, and was developed in chemistry containing: 850 ml of water; sodium sulfite (70 g); hydroquinone (33 g); NaBr (3.2 g); 5-methylbenzotriazole (0.255 g); EDTA (ethylene diamine tetraacetate) (1 g); diethylamino propanediol (15 ml); 50% of NaOH (23 ml); sodium carbonate (45 g); water q.s to 1 liter a pH of 11.6±0.5. Development conditions were 90° C./30 sec. in a tray.

Relative red sensitivity (speed) was measured using a Mark VI Eggerton (EG&G) sensitometer with 100 being an arbitrary value of minimum acceptable photographic response. Green safelight gap (arbitrary value) was measured by a spectral exposure using a diffraction gradient and neutral density as well as by timed exposures. Minimum acceptable safelight gap was over 10 nm for a 4-minute green safelight exposure.

Stain level was measured with a Macbeth densitometer in a clear (unexposed) sample and rated arbitrarily from 1 (best) to 5 (worst) with 3 being minimally acceptable.

Pepper was also measured by an arbitrary scale from 1 (best) to 5 (worst) with 3 being minimally acceptable.

The results are summarized in the Table below.

Compound, II-1 is neutral; Compound II-2 is anionic; Comparison compound II-3 is neutral. The comparison compound "4" is neutral and "5" is cationic.

| DYE | REL RED SPEED | GREEN SAFELIGHT GAP | STAIN RATE | PEPPER RATE |
|---|---|---|---|---|
| II-1 | 134 | 30 | 2 | 1 |
| II-2 | 110 | 30 | 2 | 1 |
| II-3 | 120 | 0 | 4 | 1.5 |
| | Stain and safelight gap not acceptable | | | |
| 4 | 90 | 0 | 5 | 2.5 |
| | Reject for stain, safelight gap and slow speed | | | |
| 5 | 75 | 100 | 4 | 3 |
| | Reject for slow speed, stain and pepper | | | |

The compounds "4" and "5" were used for comparison in the same amounts (II-3 was also tested for comparison). They have, respectively, the Formulas:

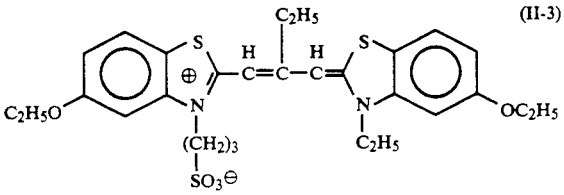
(II-3)

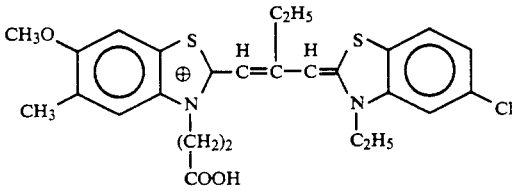
("4")

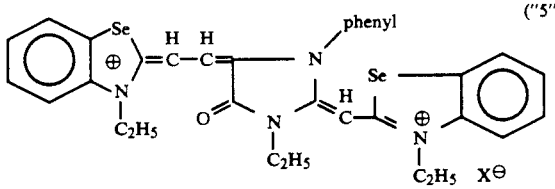
("5")

All documents and patents referred to herein are incorporated by reference.

What is claimed is:

1. A silver halide photographic material, suitable for exposure using Helium/Neon laser or light-emitting diode, comprising silver bromide grains capable of forming a surface-latent image, a binder, a dot quality-promoting amount of at least one compound of the Formula I, and an effective amount for sensitizing said grains in the red region of the spectrum only one optical sensitizer compound of the Formula II:

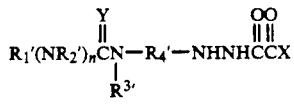
(I)

wherein:

$X = -NR_5'R_6'$, or $-OR_7'$ $R_1'$ and $R_2'$ are independently selected from the group consisting of hydrogen, substituted and unsubstituted alkyl having up to 18 carbon atoms; substituted and unsubstituted cycloalkyl, phenyl and naphthyl;

$R_3'$ is selected from the group consisting of hydrogen, substituted and unsubstituted benzyl provided that $R_3'$ is hydrogen when neither $R_1'$ and $R_2'$ are hydrogen; wherein $R_1'$ and $R_2'$ or $R_1'$ and $R_3'$ can be linked together to form a heterocyclic ring system with the ring having 3–10 carbon atoms;

$R_4'$ is a divalent aromatic group with the two valences being ortho- or para- to each other said group being substituted or unsubstituted;

$R_5'$, $R_6'$ and $R_7$ are independently selected from the group consisting of hydrogen, substituted or unsubstituted alkyl having up to 12 carbon atoms; substituted or unsubstituted cycloalkyl, phenyl and naphthyl; wherein $R_5'$ and $R_6'$ can be linked to form a heterocyclic ring system with the ring containing 3–10 atoms;

Y is selected from the group consisting of sulfur and oxygen atoms;

n is zero or one; provided that n=1 when Y is sulfur;

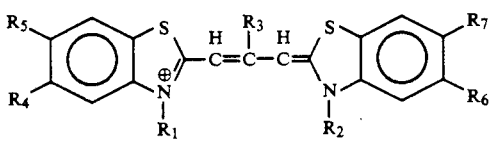
(II)

wherein:

$R_4$–$R_7$ (each independently) are lower ($C_1$–$C_6$) alkyl or lower ($C_1$–$C_6$) alkoxy;

$R_3$ is $C_1$–$C_3$ alkyl;

$R_1$–$R_2$ are independently lower carboxy alkyl, lower sulfonic acid alkyl, or lower alkyl; and wherein the compounds of Formula II are incorporated in amounts ranging from about 0.5 to about 1 mg/g Ag, and wherein said material has a relative red speed over 100, a green safe light gap of at least 30, a stain rating of two or less and a pepper rating of 2.5 or less.

2. A material according to claim 1 wherein said compound of Formula I is 1-[4'-(3''-ethylthioureido)-phenyl]-5-methyl semioxamazide.

3. A material according to claims 1 or 2 wherein said compound of Formula II is 3,3'-(3-sulfoalkyl)-5,5'-dimethyl-6,6'-dimethoxy-9-ethyl-thiacarbocyanine, inner salt, triethyl-ammonium salt.

4. A material according to claims 1 or 2 wherein the compound of Formula II is

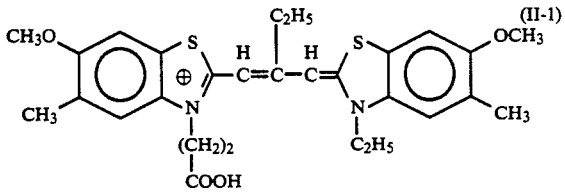
5. A material according to claims 1 or 2 wherein the compound of Formula II is
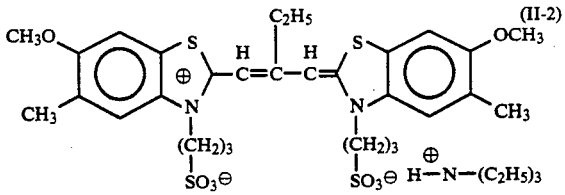
* * * * *